US007403174B2

(12) United States Patent
Lin et al.

(10) Patent No.: US 7,403,174 B2
(45) Date of Patent: Jul. 22, 2008

(54) METHOD AND APPARATUS FOR IMPROVING GRAY-SCALE LINEARITY OF PLASMA DISPLAY

(75) Inventors: Chun-Hsu Lin, Taipei Hsien (TW); Hui-Chen Lin, Taoyuan Hsien (TW); Ching-Hui Lin, Taoyuan Hsien (TW); Kuang-Lang Chen, Taoyuan Hsien (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 267 days.

(21) Appl. No.: 10/248,711

(22) Filed: Feb. 12, 2003

(65) Prior Publication Data

US 2004/0004587 A1 Jan. 8, 2004

(30) Foreign Application Priority Data

Jul. 4, 2002 (TW) ..... 91114787 A

(51) Int. Cl.
*G09G 3/28* (2006.01)

(52) U.S. Cl. ..... 345/63; 345/60; 345/61; 345/62; 345/70; 345/71; 315/169.4

(58) Field of Classification Search ..... 345/60–72, 345/690–697, 83; 315/169.4
See application file for complete search history.

(56) References Cited

U.S. PATENT DOCUMENTS

| | | | | |
|---|---|---|---|---|
| 5,818,419 | A * | 10/1998 | Tajima et al. | 345/691 |
| 5,943,032 | A * | 8/1999 | Nagaoka et al. | 345/63 |
| 6,249,265 | B1 * | 6/2001 | Tajima et al. | 345/63 |
| 6,456,302 | B2 * | 9/2002 | Kawahara et al. | 345/693 |
| 6,496,194 | B1 * | 12/2002 | Mikoshiba et al. | 345/596 |
| 6,646,625 | B1 * | 11/2003 | Shigeta et al. | 345/63 |
| 6,650,373 | B2 * | 11/2003 | Ono et al. | 348/673 |

* cited by examiner

*Primary Examiner*—Richard Hjerpe
*Assistant Examiner*—Leonid Shapiro
(74) *Attorney, Agent, or Firm*—Jianq Chyun IP Office

(57) ABSTRACT

A method and an apparatus for improving the gray-scale linearity of a plasma display. At least two types of gray-scale allocations are mixed for forming the original gray scale, or different gray scales are mixed to derive the original gray scale, so as to obtain the required brightness. Therefore, by using multiple combinations to adjust the original gray scale, the required brightness is obtained, and the gray scale linearity for all the gray scales is improved.

14 Claims, 6 Drawing Sheets

METHOD AND APPARATUS FOR IMPROVING GRAY-SCALE LINEARITY OF PLASMA DISPLAY

CROSS REFERENCE TO RELATED APPLICATIONS

This application claims the priority benefit of Taiwan application serial no. 91114787, filed on Jul. 4, 2002.

BACKGROUND OF INVENTION

1. Field of the Invention

The invention relates in general to a method and an apparatus for improving gray-scale linearity, and more particular, to a method and an apparatus for improving gray-scale linearity of a plasma display.

2. Related Art of the Invention

The earliest dynamic image that the human beings are people were able to see is was the documentary film movie. Later on, with the invention of cathode ray tube (CRT) successfully derives the came commercialized televisions, which then become the an essential appliance for every family. The cathodes ray tubes are became further applied to as the desktop monitor in computers industries for several decades. However, due to the irresolvable radiation problems and the very large volume occupied by the electron gun, the very large displays made thereof gradually have fallen behind the trends of being thin, light and of large-area.

To address the above problems, flat panel displays have been developed. The currently developed flat panel displays include liquid crystal display (LCD), field emission display (FED), vacuum fluorescent display (VFD), organic light emitting diode (OLED) and plasma display panel (PDP). Among these flat panel displays, the plasma display panel is often time applied to digital television and has great market potential due to the advantages of high resolution, high image quality, and large display area.

The generation of plasma display panel is to improve the drawbacks of cathode ray tube. It is easy for to have the electron beam to approach the screen corner by simply deflecting the electron beam with by a large angle. However, the large deflection angle results in an excessively large spot, such that the image and picture are distorted, and the resolution around the screen corners of the cathode ray tube is poor. When the internal space of the cathode ray tube is continuously expanded, it is difficult to maintain high vacuum. Therefore, fabrication of large screen is difficult. In addition, the cathode ray tube does not have the memory functions. To resolve theses drawbacks, Dr."s D. L. Bitzer and H. G. Slottow have developed the plasma display panels.

With respect to the basic structure, the plasma display panel can be classified into DC type and AC type displays. The display theory includes applying a voltage to a cell where the X-axial electrode and the Y-axial electrode intersects. When the voltage approaches to a certain level (such as 180V), the gas atom is electrically ionized. The energy level of the inert gas is thus enhanced. When the inert gas atom returns from the high energy level to the ground energy level, an ultraviolet light is generated. The fluorescent material coated in the discharge space is then excited by the ultraviolet light to emit visible light within a specific frequency. The structures for DC plasma display panel and the AC plasma display panel are very similar. For example, the intersections between the X-axial electrodes and the Y-axial electrodes are the space for discharge luminescence. The difference is that the electrode of the AC plasma display panel is coated with a dielectric layer (such as MgO), while the electrode of the DC plasma display panel does not include such a layer. Therefore, the X-axial electrodes and the Y-axial electrodes are directly exposed in the discharge space, such that electrons and ions are induced on the wall to result in the memory function.

The plasma display panel can displays various illuminations by through sustain pulse control. With regards to the method of gray scale display for the AC plasma display panel, the sustain pulse period of a field (typically 1/60 sec.) is distributed into several sub-fields (SF), where each sub-field has several a different sustain pulseperiod. By using different combinations of the sub-fields, different gray scales are displayed. To give a clearer picture, referring to FIG. 1, the brightness weight of the sub-field of an AC plasma display panel is illustrated. In FIG. 1, a field is divided into 9 sub-fields SF0 to SF8. Each sub-field includes a constant address period 102 and a different sustain period 104 according to the number of the sustain pulses. The more the sustain pulses are, the longer the sustain period 104 lasts. Assuming that 8 bits are used to represent the gray scale of the plasma display panel, there are 256 gray scales, 0-255, to be represented. Assuming that the gray scale 1 is corresponding corresponds to 20 sustain pulses, the number of sustain pulses for the sub-field SF0 is thus 20. If the number of sustain pulses for the sub-fields SF1 to SF8 are 40, 80, 140,260, 520, 920, 1360 and 1800, respectively, the sub-fields SF1 to SF8 represents the gray scales 2, 4, 7, 1 3, 26, 46, 68 and 90, respectively. Other gray scales can be assembled by allocation of different sub-fields. For example, the gray scale 5 can be assembled by the sub-fields SF0 and SF2, and the gray scale 15 can be represented by the combination of the sub-fields SF1 and SF4. Generally speaking, a simple linear relationship between the allocated gray scale and the brightness is expected. If, As as shown in FIG. 1, if the weight ratio of the number of the sustain pulses for each sub-field is SF0:SF1:SF2:SF3:SF4:SF5:SF6:SF7:SF8=1:2:4:7:13:26:46:68:90, two problems occur:

(1) The brightness ratio for each sub-field will not be 1:2:4:7:13:26:46:90; and (2) Even with the brightness ratio of 1:2:4:7:1 3:26:46:90, the brightness after combination is lower than the sum of each sub-field.

The above two problems seriously affect the linearity between gray scale and brightness, so as to affect the display quality.

To improve the gray scale linearity of the plasma display panel, in U.S. Pat. No. 5,943,032, Japanese manufacturer Fujitsu disclosed a method for changing number of sustain pulses. In this method, the number of sustain pulses for each sub-field is adjusted to improve the linearity for gray-scale versus brightness. For example, when the number of sustain pulses of gray scale 4 is 60, and the measured brightness of the gray scale 4 is lower than 60 cd/m$^2$, the number of sustain pulses for the gray scale 4 is increased to 80, such that the brightness is increased to 60 cd/m$^2$ to improve the linearity for gray scale versus brightness. However, by applying such method to the example as shown in FIG. 1, as 9 fields require only 9 kinds of sustain pulses, only 9 parameters are provided for adjustment, so that the gray scale linearity for all gray scales cannot be improved.

Another method to improve the gray scale linearity of the plasma display panel is disclosed in U.S. Pat. No. 5,943,032 by Korean Manufacturer LG. Such method employs image distortion compensation unit to add a pseudo pulse in the sustain pulse region of the sub-field to increase the brightness of the sub-field, so as to improve the linearity of gray scale versus brightness. Similarly, by applying this method to the example in FIG. 1, only 9 sustain pulses are provided by 9 sub-fields. Therefore, only 9 parameters are provided for the added pseudo pulse for adjustment. One cannot improve the gray scale linearity for all gray scales.

SUMMARY OF INVENTION

The present invention provides a method and an apparatus to improve gray scale linearity for plasma display. At least two types of gray-scale allocations are mixed for the original gray scale, or different gray scales are mixed to form the original gray scale to obtain the required brightness.

The method to improve gray scale linearity for plasma display provided by the present invention includes receiving a gray scale input value during a field period. Several kinds of gray-scale allocations are performed on the gray scale input value. According to the required brightness, these gray-scale allocations are appropriately mixed.

In one embodiment of the present invention, by a vertical synchronous signal, the gray-scale allocation is varied with one time of gray-scale allocation.

In one embodiment of the present invention, the plasma display includes a plurality of pixels, and the gray-scale allocation of each pixel can be altered arbitrarily.

The present invention further provides a method for improving the gray-scale linearity of a plasma display. Various gray-scale values are received during a field period. A gray-scale allocation is performed on each gray-scale input value. According to the required output brightness, the gray-scale allocations are appropriately mixed to output an average gray-scale value of the gray-scale input values.

The present invention further provides a method for improving the gray-scale linearity of a plasma display. Various gray-scale values are received during a field period. Various gray-scale allocations are performed on each gray-scale input value. According to the required output brightness, the gray-scale allocations are appropriately mixed to output an average gray-scale value of the gray-scale input values.

The present invention further provides a method for improving gray-scale linearity of a plasma display. The plasma display comprises a plurality of pixels, each of which uses one of a plurality of gray-scale allocations in a field, such that the average brightness displayed by the pixels is higher than that which uses a single one of these gray-scale allocations.

The apparatus for improving gray-scale linearity of a plasma display provided by the present invention comprises a gray-scale allocation apparatus, a control apparatus and a multiplexer. Various gray-scale allocations are stored in the gray-scale allocation apparatus. After receiving a gray-scale input value, the gray-scale allocation apparatus outputs several gray-scale allocation output values according to the gray-scale allocations. The control apparatus is used to receive a vertical synchronous signal and a sequence pulse signal, and to output a control signal according to the vertical synchronous signal and the sequence pulse signal. The multiplexer receives the gray-scale allocation output values. According to the control signal, one of the gray-scale allocation output values is output sequentially in a field period by the multiplexer. The gray-scale allocation output values are appropriately mixed according to the required output brightness.

In one embodiment of the present invention, an apparatus for improving gray-scale linearity of a plasma display includes a gray-scale allocation apparatus, a control apparatus and a multiplexer. The gray-scale allocation apparatus stores a gray-scale allocation to receive a plurality of gray-scale input values. These gray-scale input values are used to output corresponding output gray-scale allocation output values according to the gray-scale allocation. The control apparatus is used to receive a vertical synchronous signal and a sequence pulse signal. According to the synchronous signal and the sequence pulse signal, a control signal is output. The multiplexer is used to receive the gray-scale allocation output values. According to the control signal, one of the gray-scale allocation output values is sequentially output in a field period. The apparatus further appropriately mixes the gray-scale allocation output values according to the required output brightness, so as to output an average gray-scale value of these gray-scale input values.

The present invention further provides an apparatus for improving gray-scale linearity of a plasma display. The apparatus comprises a gray-scale allocation apparatus, a control apparatus and a multiplexer. Various gray-scale allocations are stored in the gray-scale allocation apparatus. After receiving a plurality of gray-scale input values, the gray-scale allocation apparatus outputs a plurality of corresponding gray-scale allocation output values according to the gray-scale allocations. The control apparatus is used to receive a vertical synchronous signal and a sequence pulse signal, and to output a control signal according to the vertical synchronous signal and the sequence pulse signal. The multiplexer receives the gray-scale allocation output values. According to the control signal, one of the gray-scale allocation output values is output sequentially in a field period by the multiplexer . The gray-scale allocation output values are appropriately mixed according to the required output brightness.

According to the above, the present invention mixes at least two of the above gray-scale allocations, or mixes different gray-scales to form the original gray scale, so as to obtain the required brightness. Therefore, the present invention uses various combinations to adjust the original gray scale to achieve the required brightness. The gray-scale linearity for all gray scales can be improved.

BRIEF DESCRIPTION OF DRAWINGS

These, as well as other features of the present invention, will become more apparent upon reference to the drawings wherein.

DETAILED DESCRIPTION

The present invention mixes at least two gray-scale allocations or different gray scales to form the original gray scale, so as to obtain the required brightness. For the convenience of description, two gray-scale allocations are mixed for forming the original gray scale to exemplarily introduce the method and apparatus for improving gray-scale linearity of a plasma display panel in the present invention. It is appreciated that people of ordinary skill in the art may modify the present invention by mixing more than two gray-scale allocations or more than two gray scales to obtain the required brightness without exceeding the spirit and scope of the present invention.

Figure 2:
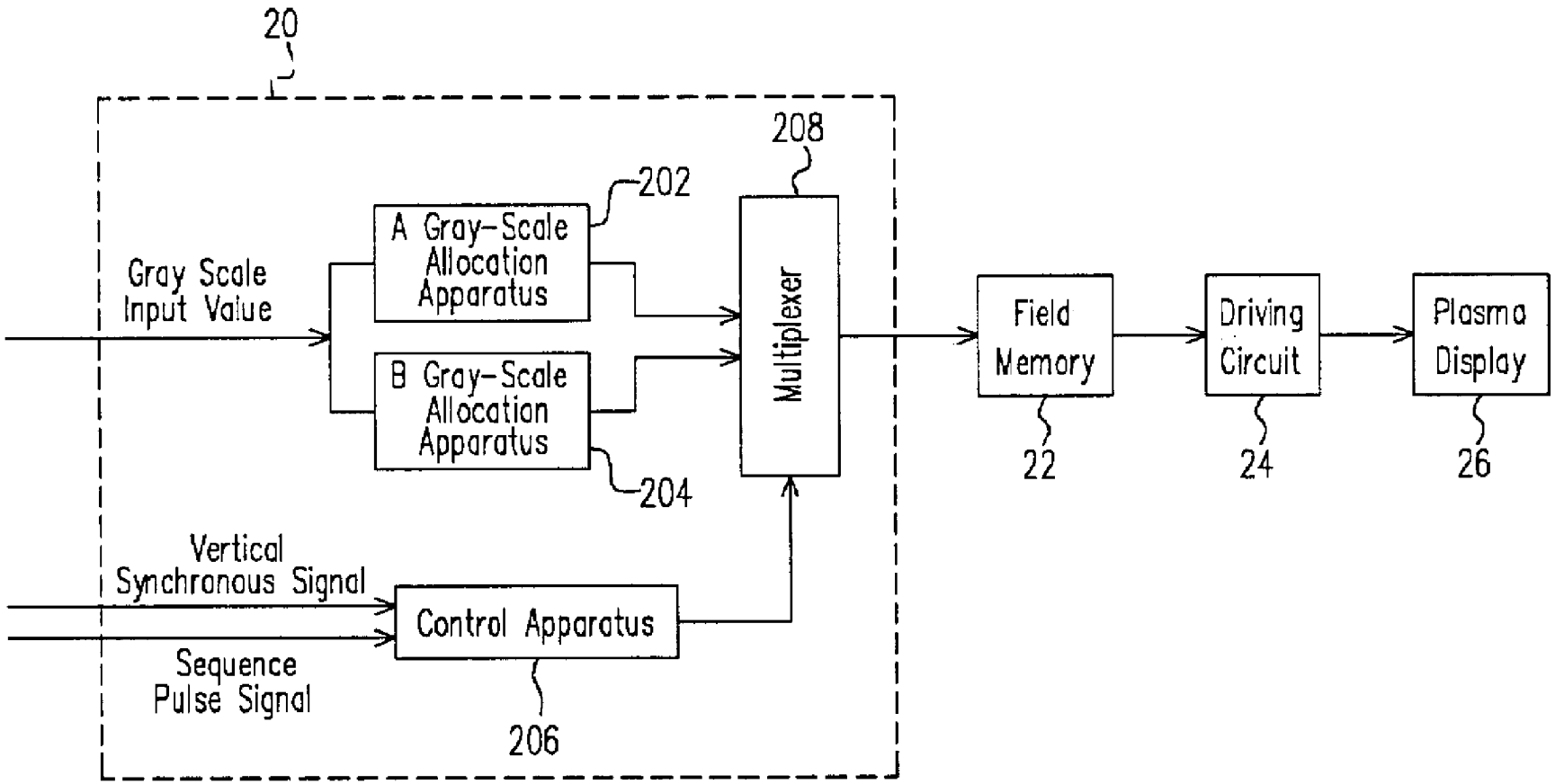
FIG. 2 is an embodiment of a circuit structure for improving gray scale linearity of a plasma display according to the present invention.

Referring to FIG. 2, a circuit structure for improving gray-scale linearity of a plasma display panel according to the present invention is shown. The circuit structure includes an apparatus 20 to improve the gray-scale linearity of a plasma display panel, a field memory 22, a driving circuit 24 and the plasma display panel 26. The apparatus 20 comprises an A gray-scale allocation apparatus 202, a B gray-scale allocation apparatus 204, a control apparatus 206, and a multiplexer 208. The operation of the circuit structure is introduced as follows.

The A gray-scale allocation apparatus 202 stores A gray-scale allocation to receive a gray-scale input value, and outputs an A gray-scale allocation output value according to the A gray-scale allocation. The B gray-scale allocation apparatus 204 stores a B gray-scale allocation to also receive the gray-scale input value too, and outputs a B gray-scale allocation output value according to the B gray-scale allocation. The control apparatus 206 is used to receive a vertical synchronous signal and a sequence pulse signal, and to output a control signal according thereto. The multiplexer 208 receives the A gray-scale allocation output value and the B gray-scale allocation output value, and sequentially outputs output one of the A and B gray-scale allocation output values in a field period according to the control signal. For example, if a field is assembled by 3 sub-fields. In in a field period, the output of the multiplexer 208 may includes the A gray-scale allocation output value, the B gray-scale allocation output value, and the B gray-scale allocation output value. The apparatus 20 appropriately mixes the A gray-scale allocation output value and the B gray-scale allocation output value according to the required brightness. The field memory 22 stores the gray-scale allocation output value for each field. According to the gray-scale allocation output value stored in the field memory 22, the driving circuit 24 applies a voltage to the X-axial electrode and the Y-axial electrode to drive the plasma display panel 26. In addition, the gray-scale allocation output value is changed with one gray-scale allocation via the vertical synchronous signal. Further, the plasma display panel includes a plurality of pixels, and the gray-scale allocation for each of which is arbitrarily variable.

Figure 1:
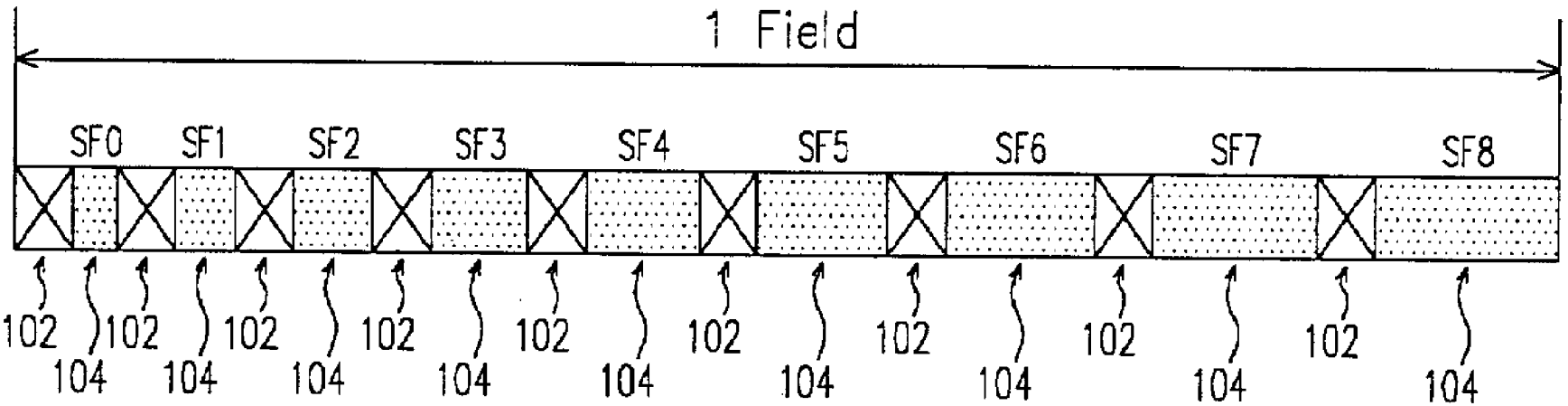
FIG. 1 (PRIOR ART)
FIG. 1 shows a brightness weight ratio of sub-field of an AC type plasma display panel.
Figure 3:
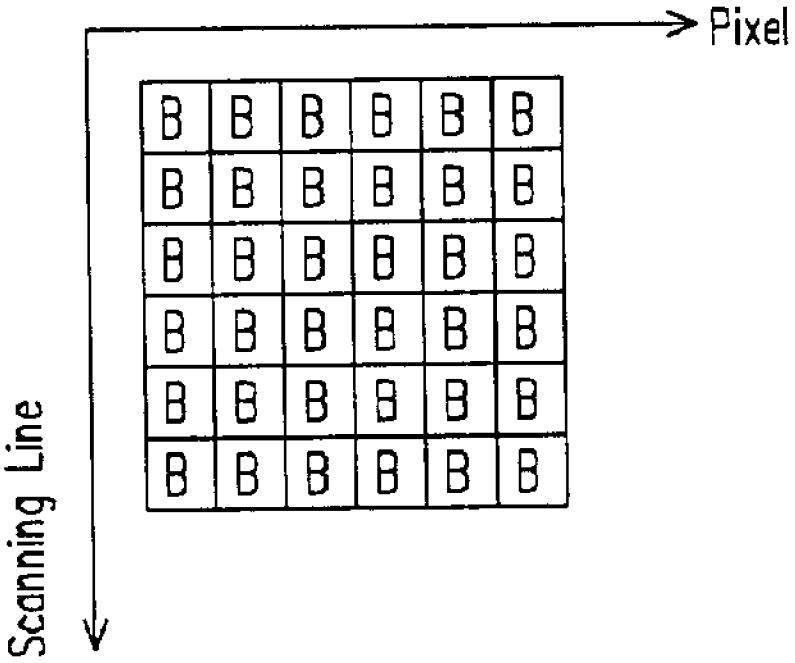
FIG. 3 is a schematic drawing for a space with A gray-scale allocation and B gray-scale allocation.
Figure 3:
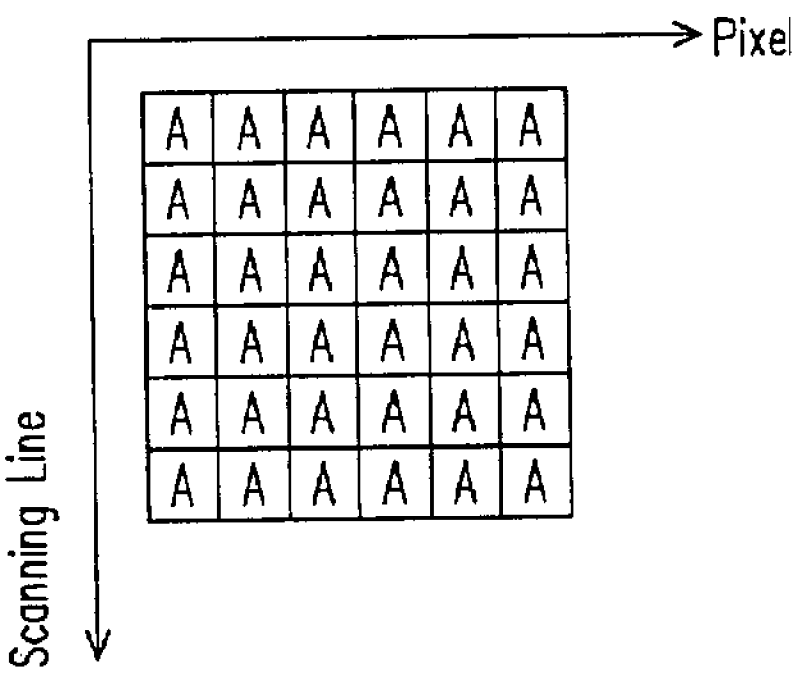
Figure 4:
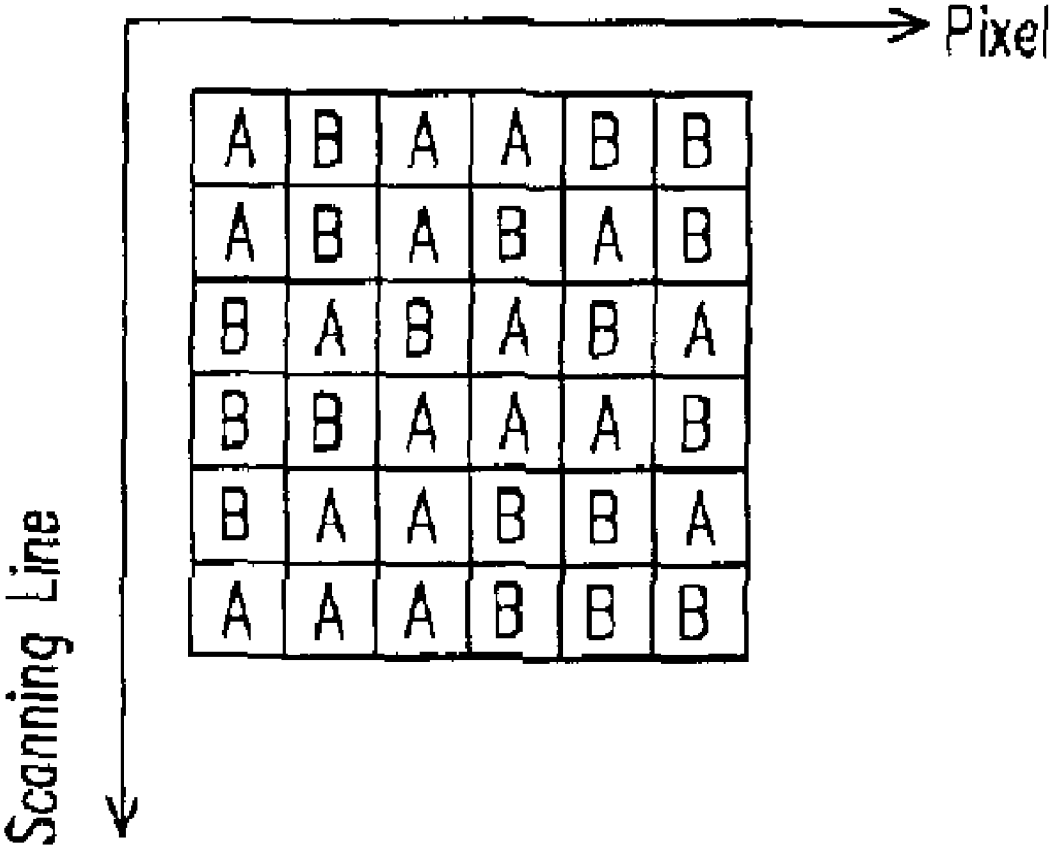
FIG. 4 is aschematic drawing for a space with a mixture of the A gray-scale allocations and the B gray-scale allocations.

The following introduces a method of using the above apparatus to improve the gray-scale linearity of a plasma display panel. Two gray-scale allocations are mixed for forming an original gray scale, so as to obtain a required brightness. In a field period, the A gray-scale allocation apparatus 202 and the B gray-scale allocation apparatus 204 receive the same gray-scale input value. The A and B gray-scale allocations are performed on the gray-scale input value, respectively. According to the required output brightness, the A and B gray-scale allocations are appropriately mixed. Assuming Assume that when the space is full of the A gray-scale allocations, the brightness is $L_A$ while the brightness is $L_B$ when the space is full of the B gray-scale allocations. As shown in FIG. 3, when the space has N A gray-scale allocations and M B gray-scale allocations mixed together, the average brightness $L_{AB}$ is larger than the mean value of the brightness $L_A$ and $L_B$ of the solely the A and B gray-scale allocations. That is, $L_{AB} \cong (N \times L_A + N \times L_B)/(N+M)$. This is because in one field, the maximum current consumed by the pixels with N of the A gray-scale allocations and M of the B gray-scale allocations is smaller than the maximum current consumed by pixels with all A gray-scale allocations and with all B gray-scale allocations at the same time. Therefore, the brightness displayed in the field using multiple kinds of gray-scale allocations is higher than that of the field using only single type of gray-scale allocation. If the space is filled with a mixture of the A gray-scale allocations and the B gray-scale allocations, and each of which occupy one half of the pixels, the brightness $L_{AB}$ is larger than $(L_A+L_B)/2$, as shown in FIG. 4. For example, in the example as shown in FIG. 1, the original gray scale 14 has two types of gray-scale allocations, one is 1+2+4+7, while the other is 1+13. The brightness for these two types of gray-scale allocations is both low. Meanwhile, the gray scale 14 may appropriately mix these two gray-scale allocations to achieve the desired brightness.

Figure 5:
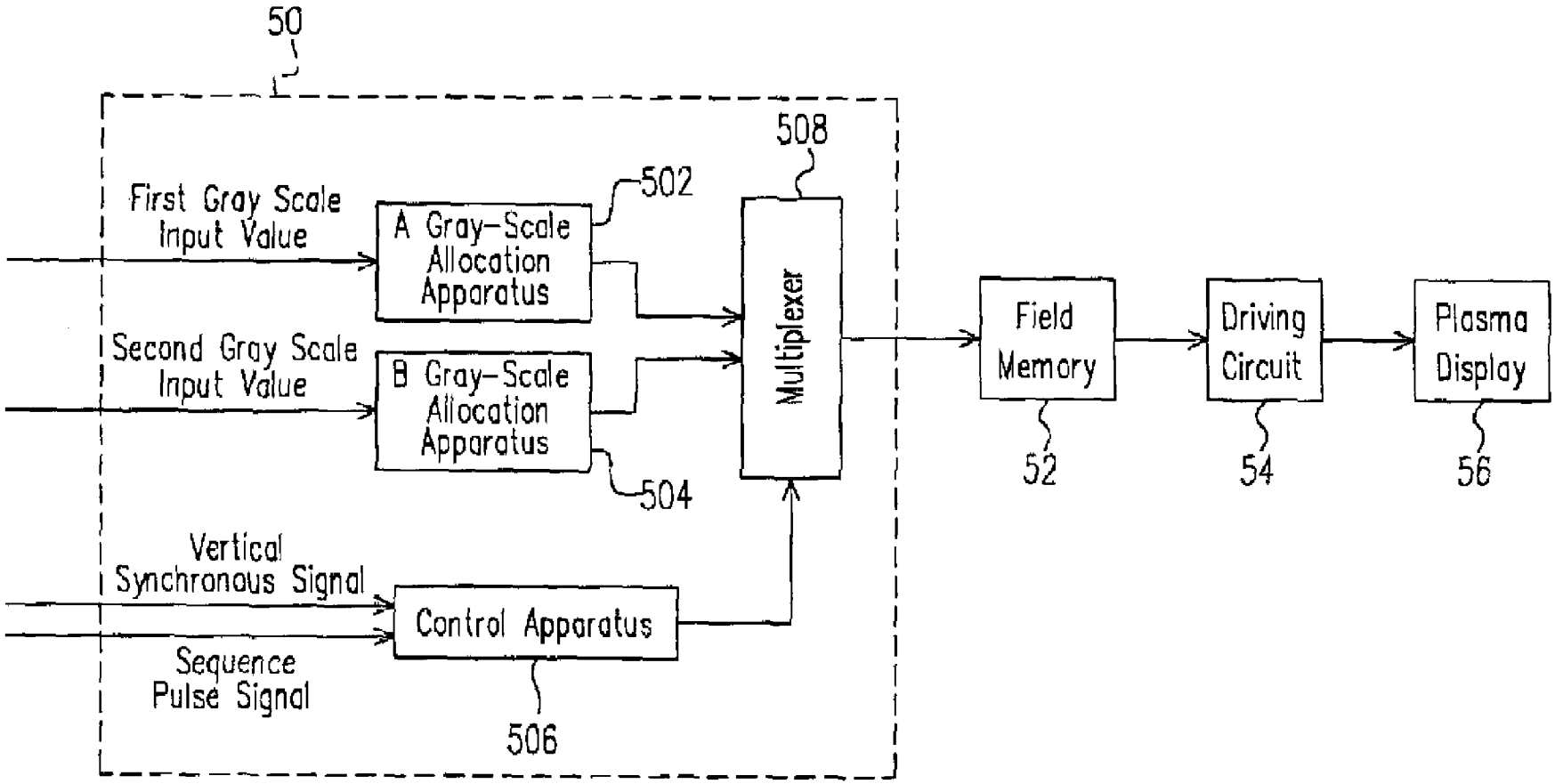
FIG. 5 is another embodiment of a circuit structure for improving gray-scale linearity of a plasma display according to the present invention.

The circuit structure of improving the gray-scale linearity of a plasma display panel according to another embodiment of the present invention is shown in FIG. 5. The circuit structure includes an apparatus 50 to improve the gray-scale linearity of a plasma display panel, a field memory 52, a driving circuit 54 and the plasma display panel 56. The apparatus 50 comprises an A gray-scale allocation apparatus 502, a B gray-scale allocation apparatus 504, a control apparatus 506, and a multiplexer 508. The field memory 52, the driving circuit 54 and the plasma display panel 56 are similar to those shown in FIG. 2, such that only the operation of the apparatus 50 is described as follows.

The A gray-scale allocation apparatus 502 stores A gray-scale allocation to receive a gray-scale input value, and outputs an A gray-scale allocation output value according to the A gray-scale allocation. The B gray-scale allocation apparatus 504 stores a B gray-scale allocation to also receive the gray-scale input value too, and outputs a B gray-scale allocation output value according to the B gray-scale allocation. The control apparatus 506 is used to receive a vertical synchronous signal and a sequence pulse signal, and to output a control signal according thereto. The multiplexer 508 receives the A gray-scale allocation output value and the B gray-scale allocation output value, and sequentially outputs output one of the A and B gray-scale allocation output values in a field period according to the control signal. The apparatus 50 appropriately mixes the A gray-scale allocation output value and the B gray-scale allocation output value according to the required brightness, and outputs the average gray-scale value of the A gray-scale allocation output value and the B gray-scale allocation output value.

The following description introduces another method for improving the gray scale linearity of a plasma display. Two gray scales are mixed to form the original gray scale. Gray-scale allocation is performed on these two different gray scales separately to obtain the required brightness. In a field period, the A gray-scale allocation apparatus 502 receives a first gray scale input value, while the B gray-scale allocation apparatus 504 receive a second gray scale input value. The A gray-scale allocation apparatus outputs an A gray-scale allocation output value according to the gray-scale allocation, and the B gray-scale allocation apparatus outputs a B gray-scale allocation output value according to the gray-scale allocation. The A gray-scale allocation output value and the B gray-scale allocation output value are appropriately mixed according to the required brightness, such that the average gray-scale value of the A and B gray-scale allocation output values is output. For example, the gray scale 14 can be formed by mixing the gray scale 1413 with gray-scale allocation of 2+4+7 and the gray scale 15 with gray-scale allocation of 2+13 to achieve the required brightness.

Figure 6:
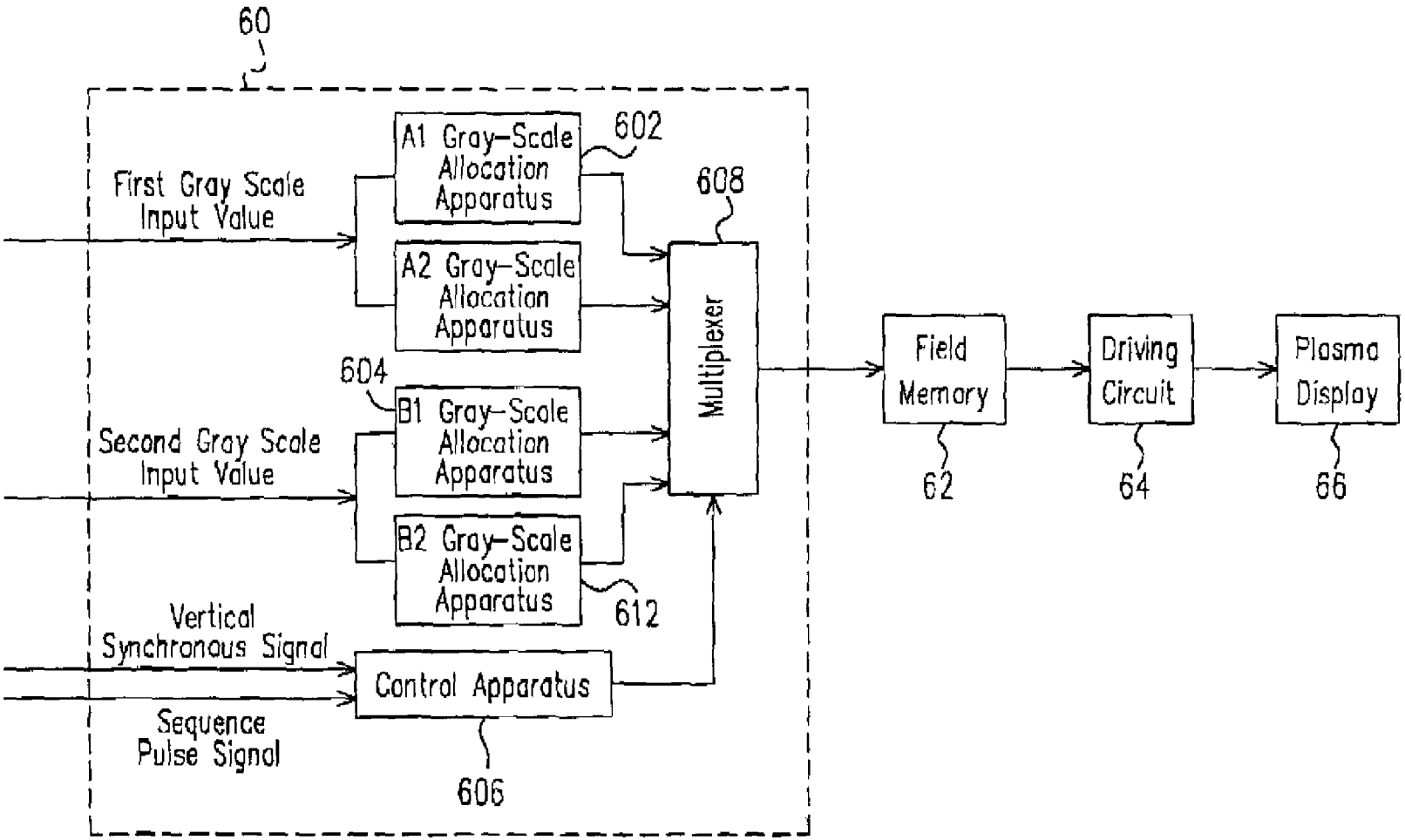
FIG. 6 is yet another embodiment of a circuit structure for improving gray-scale linearity of a plasma display according to the present invention.

The circuit structure of improving the gray-scale linearity of a plasma display panel according to another embodiment of the present invention is shown in FIG. 6. The circuit structure includes an apparatus 60 to improve the gray-scale linearity of a plasma display panel, a field memory 62, a driving circuit 64 and the plasma display panel 66. The apparatus 60 comprises an A1 gray-scale allocation apparatus 602, an A2 gray-scale allocation apparatus 610, a B1 gray-scale allocation apparatus 604, a B2 gray-scale allocation apparatus 612, a control apparatus 606, and a multiplexer 608. The field memory 62, the driving circuit 64 and the plasma display panel 66 are similar to those shown in FIG. 2, such that only the operation of the apparatus 60 is described as follows.

The A1 and A2 gray-scale allocation apparatuses 602 and 610 store A1 and A2 gray-scale allocations to receive a first gray-scale input value, and output an A1 and an A2 gray-scale allocation output values according to the A1 and A2 gray-scale allocations. The B1 and B2 gray-scale allocation apparatuses 604 and 612 store a B1 and a B2 gray-scale allocations to receive a second gray-scale input value, and outputs a B1 and a B2 gray-scale allocation output values according to the B1 and B2 gray-scale allocations. The control apparatus 606 is used to receive a vertical synchronous signal and a sequence pulse signal, and to output a control signal according thereto. The multiplexer 608 receives the A1 and A2 gray-scale allocation output values and the B1 and B2 gray-scale allocation output values, and sequentially outputs one of these gray-scale allocation output values in a field period according to the control signal. The apparatus 60 appropriately mixes these gray-scale allocation output values according to the required brightness, and outputs the average gray-scale value of these gray-scale allocation output values.

The following introduces a method of using the above apparatus to improve the gray-scale linearity of a plasma display panel. Two gray scales are mixed for forming an original gray scale, and a gray-scale allocation is performed on each of the two gray scales to obtain a required brightness. In a field period, the A1 gray-scale allocation apparatus 602 and the A2 gray-scale allocation apparatus 610 receive a first gray-scale input value, while the B1 and B2 gray-scale allocation apparatus 604 and 612 receive the second gray-scale input value. According to the first gray scale input value, the A1 and A2 gray scale allocation apparatus 602 and 610 output an A1 and an A2 gray-scale allocation output values, respectively. According to the second gray scale input value, the B1 and B2 gray-scale allocation apparatus 604 and 612 output a B1 and a B2 gray-scale allocation output values. According to the required output brightness, these gray-scale allocation output values are appropriately mixed, and the average gray-scale value of these gray-scale allocation output values is output. For example, the gray scale 21 may be formed by mixing the gray scale 15 with gray-scale allocation of 1+7+7, the gray scale 15 with the gray-scale allocation of 2+13, the gray scale 27 with the gray-scale allocation of 1+26, and the gray scale 27 with gray-scale allocation of 1+2+4+7+13 to achieve the required brightness.

According to the above, the present invention includes the following advantages. At least two gray-scale allocations or two gray scales are mixed to form the original gray scale, such that the required brightness can be achieved. As the present invention obtains the original gray scale by adjustment of various combinations, such that the desired brightness is obtained, while the gray-scale linearity of all the gray scales 256 can be improved.

Other embodiments of the invention will appear to those skilled in the art from consideration of the specification and practice of the invention disclosed herein. It is intended that the specification and examples are to be considered as exemplary only, with a true scope and spirit of the invention being indicated by the following claims.

The invention claimed is:

1. A method for improving gray-scale linearity of a plasma display, comprising:

receiving a plurality of gray scale input values in a field period; and allocating each of the gray scale input values according to a first gray scale allocation and a second gray-scale allocation to obtain a first gray-scale allocation value and a second gray-scale allocation value;

storing the first gray-scale allocation values and the second gray-scale allocation values;

selecting one of the first gray-scale allocation value and the second gray-scale allocation value of the gray scale input value as an allocation value for a corresponding one of a plurality of sub-fields within the field period according to a required brightness; and driving the plasma display by using the allocation values corresponding to the sub-fields within the field period.

2. The method according to claim 1 wherein a portion of the allocation values are formed from the gray scale input values allocated according to the first gray-scale allocation and the others of the allocation values are formed from the gray scale input values allocated according to the second gray-scale allocation.

3. The method according to claim 1, wherein selecting the allocation values for the sub-fields is according to a vertical synchronous signal.

4. The method according to claim 1, wherein selecting the allocation value for the corresponding sub-field is respectively performed on each of a plurality of pixels in the plasma display.

5. A method for improving gray-scale linearity of a plasma display, comprising:

receiving a plurality of gray scale input values in a field period; and allocating each of the gray scale input values according to a first gray-scale allocation and a second gray-scale allocation to obtain a first gray-scale allocation value and a second gray-scale allocation value;

storing the first gray-scale allocation values and the second gray-scale allocation values;

obtaining an average allocation value of the first gray-scale allocation value and the second gray-scale allocation value of the gray scale input value for a corresponding one of a plurality of sub-fields within the field period; and driving the plasma display by using the average allocation values corresponding to the sub-fields within the field period.

6. The method according to claim 5, wherein selecting the allocation values for the sub-fields is according to a vertical synchronous signal.

7. The method according to claim 5, wherein selecting the allocation value for the corresponding sub-field is respectively performed on each of a plurality of pixels in the plasma display.

8. An apparatus for improving gray-scale linearity of a plasma display, comprising:

a first gray-scale allocation apparatus and a second ray-scale allocation apparatus, for receiving a plurality of gray scale input values in a field period, allocating each of the gray scale input values according to a first gray-scale allocation in the first gray-scale allocation apparatus and a second gray-scale allocation in the second ray-scale allocation apparatus to respectively obtain a first gray-scale allocation value and a second gray-scale allocation value;

a control apparatus, to receive a vertical synchronous signal and a sequence pulse signal, and to output a control signal according to the vertical synchronous signal and the sequence signal; and a multiplexer, under control of the control signal to receive and select one of the first gray-scale allocation value and the second gray-scale allocation value of the gray scale input value as an allocation value for a corresponding one of a plurality of sub-fields within the field period according to a required brightness, wherein the allocation values are used for driving the plasma display.

9. The apparatus according to claim 8, wherein a portion of the allocation values are formed from the gray scale input values allocated according to the first gray-scale allocation and the others of the allocation values are formed from the gray scale input values allocated according to the second gray-scale allocation.

10. The apparatus according to claim 8, further comprising a field memory for storing the allocation values the plurality of sub-fields within the field period; and a driving circuit, for driving the plasma display by using the allocation values.

11. The apparatus according to claim 8, wherein the plasma display comprises a plurality of pixels, the allocation values of the pixels are arbitrarily changed.

12. An apparatus for improving gray-scale linearity of a plasma display, comprising:

a plurality of gray-scale allocation apparatuses, for receiving a plurality of gray scale input values in a field period, allocating each of the gray scale input values according to a plurality of gray-scale allocations in the gray-scale allocation apparatuses to respectively obtain a plurality of gray-scale allocation values;

a control apparatus, to receive a vertical synchronous signal and a sequence pulse signal, and to output a control signal according to the vertical synchronous signal and the sequence signal; and a multiplexer, under control of the control signal to receive and select one of the gray-scale allocation values of the gray scale input values as allocation values for a plurality of sub-fields within the field period according to a required brightness, wherein the allocation values are used for driving the plasma display.

13. The apparatus according to claim 12, further comprising a field memory for storing the allocation values the plurality of sub-fields within the field period; and a driving circuit, for driving the plasma display by using the allocation values.

14. The apparatus according to claim 12, wherein the plasma display comprises a plurality of pixels, the allocation values of the pixels are arbitrarily changed.

* * * * *